US008079654B2

(12) United States Patent
Yu et al.

(10) Patent No.: US 8,079,654 B2
(45) Date of Patent: Dec. 20, 2011

(54) MOUNTING APPARATUS FOR SLIDE RAIL

(75) Inventors: Mo-Ming Yu, Shenzhen (CN); Hai-Chen Zhou, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 750 days.

(21) Appl. No.: 12/202,324

(22) Filed: Sep. 1, 2008

(65) Prior Publication Data

US 2009/0315434 A1 Dec. 24, 2009

(30) Foreign Application Priority Data

Jun. 19, 2008 (CN) ..... 2008 1 0302234

(51) Int. Cl.
*A47B 88/00* (2006.01)

(52) U.S. Cl. ..... 312/334.4; 211/26

(58) Field of Classification Search ..... 312/333, 312/334.1, 334.4, 334.7; 248/220.21, 220.22, 248/220.41, 221.11, 222.14, 244; 211/26, 211/192, 126.15; 384/21
See application file for complete search history.

(56) References Cited

U.S. PATENT DOCUMENTS

| | | | | |
|---|---|---|---|---|
| 6,373,707 | B1 * | 4/2002 | Hutchins | 361/725 |
| 6,666,340 | B2 * | 12/2003 | Basinger et al. | 211/26 |
| 6,702,124 | B2 * | 3/2004 | Lauchner et al. | 211/26 |
| 6,736,277 | B2 * | 5/2004 | Lauchner et al. | 211/26 |
| 6,796,625 | B2 * | 9/2004 | Lauchner et al. | 312/334.46 |
| 7,144,184 | B1 * | 12/2006 | Tsai | 403/350 |
| 7,703,734 | B2 * | 4/2010 | Chen et al. | 248/298.1 |
| 2003/0160010 | A1 * | 8/2003 | Robertson | 211/26 |
| 2005/0274680 | A1 * | 12/2005 | Allen et al. | 211/26 |
| 2008/0078899 | A1 * | 4/2008 | Chen et al. | 248/220.21 |
| 2008/0203251 | A1 * | 8/2008 | Chen et al. | 248/200 |

* cited by examiner

*Primary Examiner* — James O Hansen
*Assistant Examiner* — Matthew Ing
(74) *Attorney, Agent, or Firm* — Altis Law Group, Inc.

(57) ABSTRACT

A mounting apparatus is for mounting a slide rail to a support of an electronic equipment cabinet. The mounting apparatus includes a mounting bracket slidably engaging with the slide rail, a locking member attached to the mounting bracket, and a supporting member movably located between the locking member and the mounting bracket. A post extends from the mounting bracket configured for being received in a through hole of the support of the cabinet. The locking member includes a resisting portion, which is capable of being urged to engage with the support by the supporting member.

14 Claims, 5 Drawing Sheets

MOUNTING APPARATUS FOR SLIDE RAIL

BACKGROUND

1. Field of the Invention

The present invention relates to mounting apparatuses and, more particularly, to a mounting apparatus for a slide rail.

2. Description of Related Art

Traditionally, a slide rail is used between two objects that can move relative to each other, such as between a desk and a drawer, a server and a rack, etc.

A conventional slide rail assembly for a drawer and a desk includes an outer slide rail mounted to the desk, an inner slide rail mounted to the drawer, and an intermediate slide rail mounted between the outer and inner slide rails. The intermediate slide rail is extendable relative to the outer slide rail, and the inner slide rail is extendable relative to the intermediate slide rail, thus the drawer can be extended a distance out from the desk. A plurality of screws is used for mounting the outer slide rail to a bracket of the desk. Therefore, installing/uninstalling the outer slide rail to/from the bracket is inconvenient and time-consuming.

DETAILED DESCRIPTION

Figure 1:
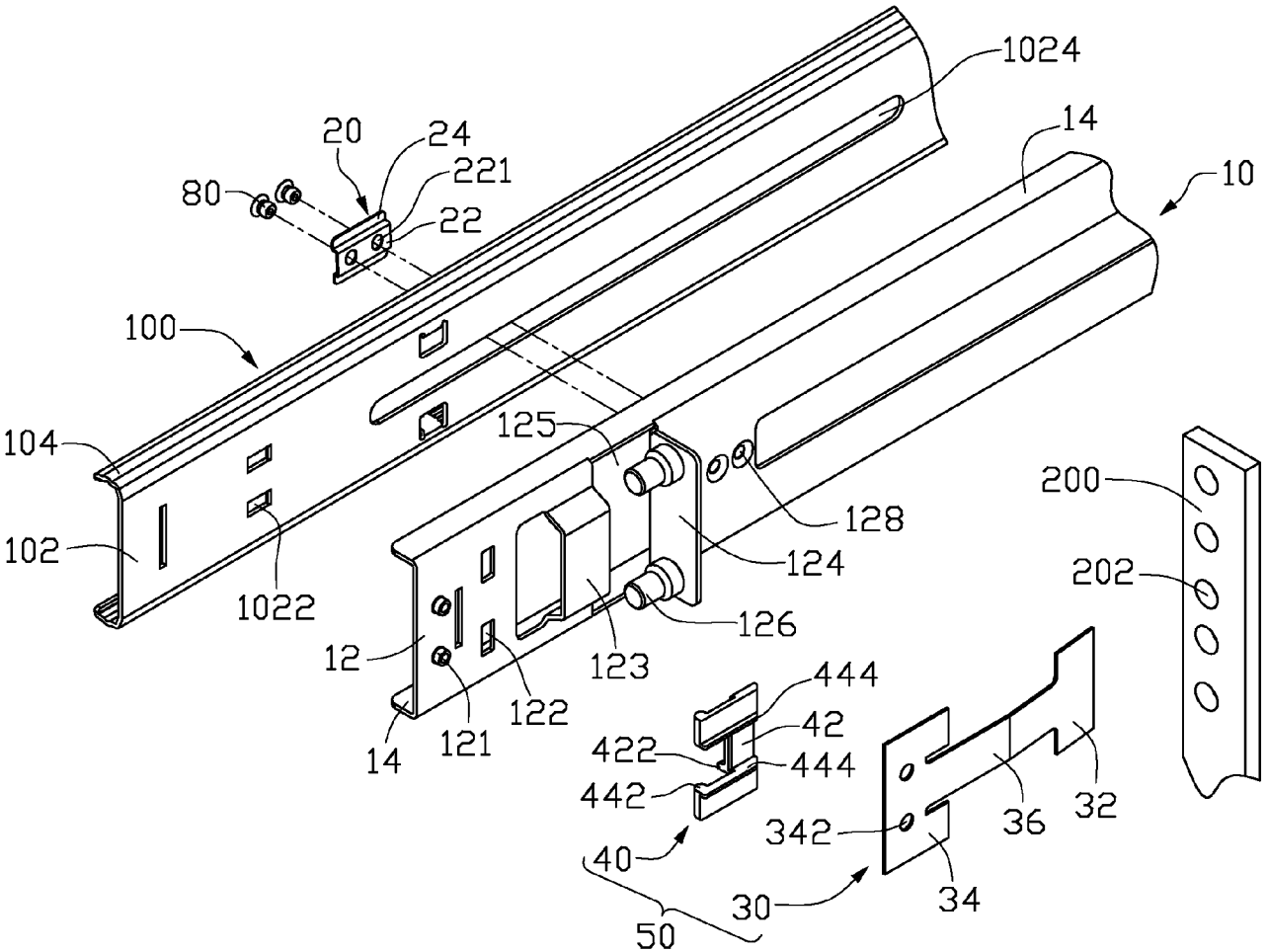
FIG. 1 is an exploded, isometric view of a mounting apparatus according to an embodiment of the present invention.
Figure 2:
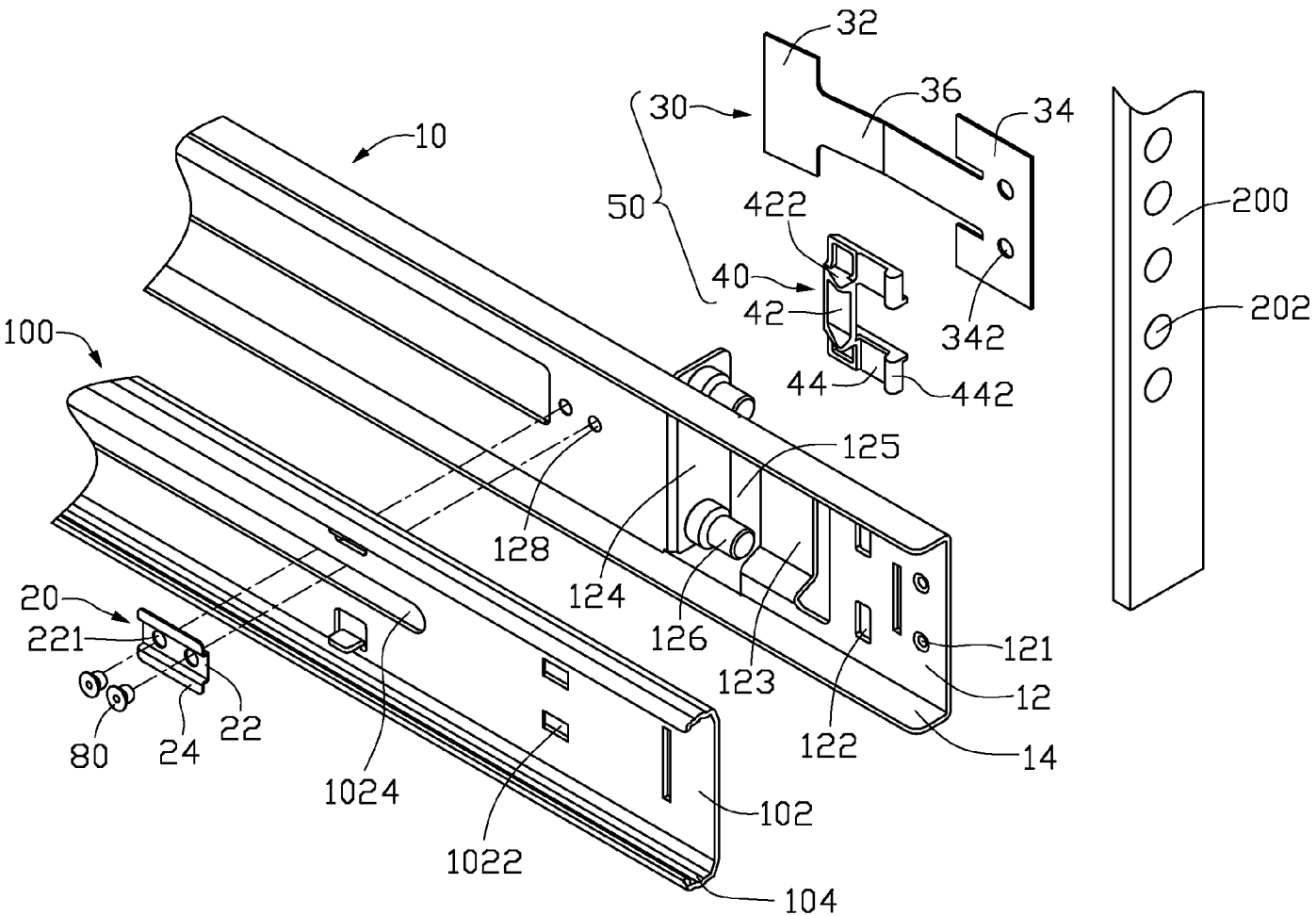
FIG. 2 is similar to FIG. 1, but viewed from another aspect.

Referring to FIGS. 1 and 2, in an embodiment of the present invention, a mounting apparatus is provided for mounting a slide rail 100 to a support 200 of an electronic equipment cabinet. The mounting apparatus includes a mounting bracket 10, a clipping element 20 fixed to the mounting bracket 10 and slidably engaging with the slide rail 100, and a locking mechanism 50.

The slide rail 100 defines a substantially C-shaped cross section, and includes a base wall 102 and two sidewalls 104 extending from opposite sides of the base wall 102 respectively. The base wall 102 defines a pair of receiving portions 1022 near an end and a sliding slot 1024 extending along a longitudinal direction of the slide rail 100 in a middle area.

The support 200 includes a plurality of through holes 202 defined therein and arranged from top to bottom.

The mounting bracket 10 includes a base wall 12 and a pair of flanges 14 substantially perpendicularly extending from opposite edges of the base wall 12. Therefore, the mounting bracket 10 is capable of enclosing the slide rail 100 in a space defined by the base 12 and the flanges 14. The base wall 12 successively arranges a pair of protrusions 121 extending therefrom, a pair of locating holes 122 defined therein, an arc portion 123 protruding therefrom, a blocking plate 124 perpendicularly extending therefrom, and a pair of fixing holes 128 defined therein. The base wall 12 also defines a window 125 therein, which aligns with the arc portion 123 and communicates with the blocking plate 124. The blocking plate 124 extends in an opposite direction relative to the flange 14 and includes a pair of posts 126 extending towards the arc portion 123.

A middle area of the clipping element 20 is raised to form a fixing portion 22. A pair of wings 24 extends from opposites edges of the fixing portion 22. A pair of securing holes 221 is defined in the fixing portion 22.

In the present embodiment, the locking mechanism 50 includes a locking member 30 and a supporting member 40. The locking member 30 is a substantially H-shaped resilient metal plate. The locking member 30 includes a resisting portion 32, a positioning portion 34, and a slightly bent arm 36 connecting the resisting portion 32 to the positioning portion 34. A pair of fastening holes 342 is defined in the positioning portion 34.

The supporting member 40 is made of a resilient material, and includes a main body 42 and a pair of substantially parallel legs 44 extending from an edge of the main body 42. A pair of wedge-shaped portions 422 extends from a side surface of the main body 42. Each leg 44 forms a retaining portion 442 at a distal end thereof. A pair of parallel guiding plates 444 is formed on the sides of the corresponding legs 44 facing each other.

Figure 3:
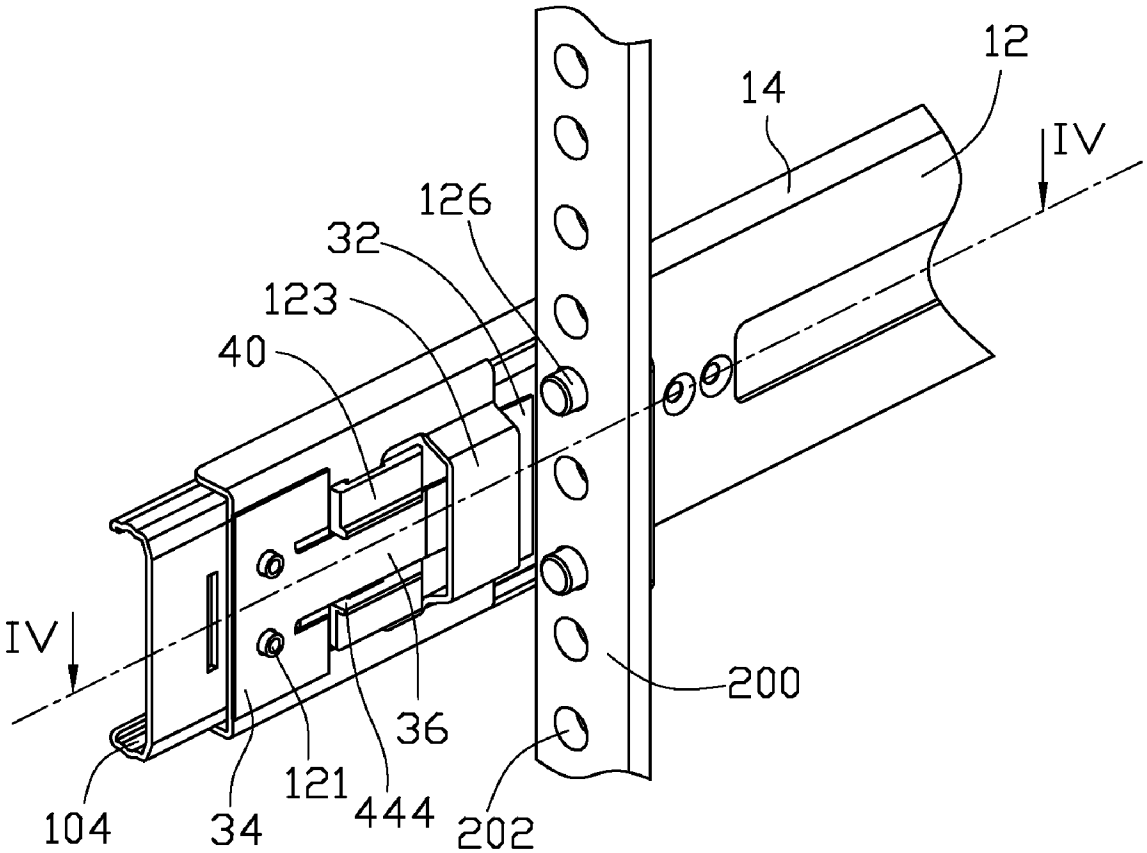
FIG. 3 is an assembled, isometric view of FIG. 1.
Figure 4:
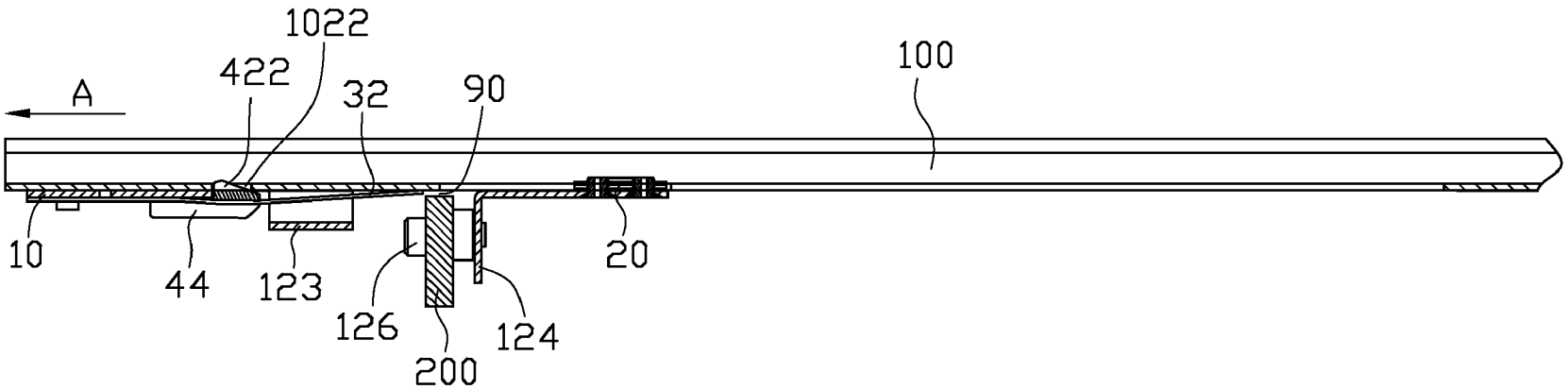
FIG. 4 shows a sectional view of FIG. 3, taken along the line IV-IV in FIG. 3.

Referring also to FIGS. 3 and 4, in assembly of the mounting apparatus, the supporting member retaining portion 442 is secured in the mounting bracket locating hole 122. The supporting member main body 42 extends towards the arc portion 123 and the wedge-shaped portions 422 extend through the mounting bracket window 125. The locking member arm 36 extends through the arc portion 123 and a recessed surface of the arm 36 faces the mounting bracket base wall 12. The mounting bracket protrusions 121 are fastened in the locking member fastening holes 342. The arm 36 abuts against the supporting member main body 42 and is placed between the guiding plates 444. The locking member resisting portion 34 is located between the arc portion 123 and the blocking plate 124.

To mount the mounting apparatus to the slide rail 10, the side of the slide rail 100 is enclosed in the mounting bracket 10. The mounting bracket base wall 12 abuts against the side rail base wall 102 and the mounting bracket flanges 14 abut against the corresponding slide rail sidewalls 104. The clipping element fixing portion 22 passes through the slide rail sliding slot 1024 from an inner side of slide rail 100 and is secured to the mounting bracket 10 with a pair of fastening members 80 correspondingly fixed in the clipping element securing holes 221 and the mounting bracket fastening holes 128. The clipping element wings 24 abut against an inner surface of the base wall 102. Therefore, the mounting bracket 10 is retained to slidably engage with the slide rail 100 by the clipping element 20. The mounting bracket 10 slides relative to the slide rail 100 to an initial position, in which the supporting member wedge-shaped portions 422 are received in the slide rail receiving portions 1022. Therefore, the supporting member main body 42 abuts against the mounting bracket 10. The locking member resisting portion 32 passing through the window 125 and abuts against the slide rail base wall 102.

Figure 5:
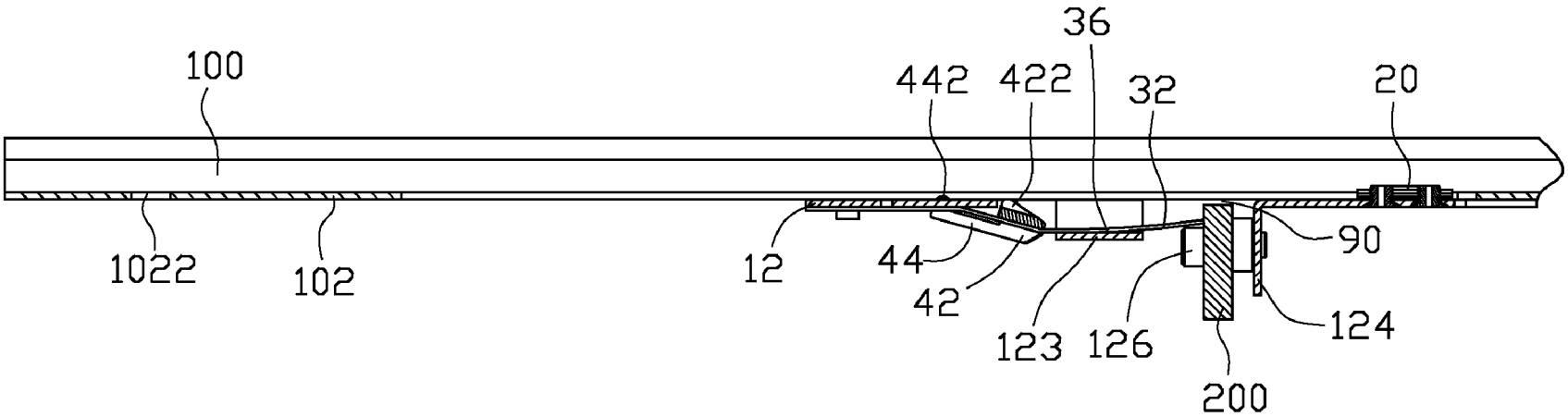
FIG. 5 shows another sectional view similar to FIG. 4, but the slide rail is retained to the support.

Referring also to FIG. 5, to attach the slide rail 100 to the support 200, the slide rail 100 in association with the mounting apparatus is moved to extend the posts 126 into the support through holes 202. Then, the slide rail 200 is slid in a direction indicated by arrow A (shown in FIG. 4). Because the mounting bracket 10 is stopped by the support 200, the mounting bracket 10 slides relative to the slide rail 100.

The wedge-shaped portions 422 move out of the receiving portions 1022 with the sliding movement of the slide rail 100. The slide rail base wall 102 resists against wedge-shaped portions 422 to raise the supporting member main body 42 from the mounting bracket base wall 12. Thus the main body 42 urges the locking member arm 36 to move away from base wall 12, and the locking member resisting portion 32 moves with the arm 36 to resist against the support 200 to retain the posts 126 in support through holes 202. The arc portion 123 prevents the locking member arm 36 moving to far out from the mounting bracket 10 to protect the locking member 30 from being damaged.

In releasing the slide rail 100 from the support 200, the slide rail 100 is slid in a direction opposite to that indicated by arrow A. The mounting bracket 10 is stopped by the support 200, which engages with the locking member resisting portion 32, so that the slide rail slides relative to the mounting bracket 10. When the slide rail receiving portion 1022 aligns with and receives the supporting member wedge-shaped portions 422, the supporting member 40 and the locking member 30 are restored. The locking member resisting portion 32 disengages from the support 200. Therefore, the posts 126 can be drawn out of the support through holes 202.

In alternative embodiments, the locking mechanism 50 may be a single-component member capable of the same functions as the assembly of the locking member 30 and the supporting member 40 described as above. The single-component member may include a mounting portion attached to the mounting bracket 10, a pair of wedge-shaped portions selectively received in the slide rail receiving portions 1022 or resisting against the slide rail base wall 102, and a resisting member capable of resisting against the support 200.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A mounting apparatus for mounting a slide rail to an electronic equipment cabinet with a support, the apparatus comprising:

a mounting bracket slidably engaging with the slide rail defining at least one receiving portion therein, and comprising at least one post capable of extending into a through hole of the support;

a locking member comprising a positioning portion fixed to the mounting bracket, a resisting portion formed at an end of the locking member opposite to the positioning portion and capable of resisting against the support to prevent the post from exiting from the support through hole, and an arm connected between the positioning portion and the resisting portion; and a supporting member movably located between the locking member and the mounting bracket, wherein the supporting member comprises a wedge-shaped portion extending through the mounting bracket towards the slide rail; when the mounting bracket slides relative to the slide rail, the wedge-shaped portion is selectively pressed by the slide rail to drive the locking member resisting portion to resist against the support, or received in the slide rail receiving portion to disengage the locking member resisting portion from the support;

wherein the arm is bent with a recessed surface facing the mounting bracket; when the wedge-shaped portion is received in the receiving portion, the locking member resisting portion aligns with a gap between the support and the mounting bracket thereby releasing the mounting bracket from the support.

2. The mounting apparatus as described in claim 1, wherein the mounting bracket further comprises a blocking plate, the post of the mounting bracket extends from the blocking plate.

3. The mounting apparatus as described in claim 1, wherein the positioning portion comprises a plurality of fastening holes configured to engage with a plurality of protrusions formed on the mounting bracket.

4. The mounting apparatus as described in claim 1, wherein the mounting bracket further comprises a window; when the wedge-shaped portion is received in the receiving portion, the locking member resisting portion is configured to pass through the window and abuts against the slide rail.

5. The mounting apparatus as described in claim 1, wherein the mounting bracket further comprises an arc portion for the locking member arm to pass through.

6. The mounting apparatus as described in claim 1, wherein the supporting member further comprises a main body abutting against the locking member; the wedge is formed on the main body; the locking member is urged away from the mounting bracket when the wedge resists against the slide rail.

7. The mounting apparatus as described in claim 6, wherein the supporting member further comprises a pair of legs extending from the main body, each leg forms a retaining portion at a distal end; the mounting bracket further comprises a pair of locating holes configured to fix the retaining portions therein.

8. An assembly comprising:

an electronic equipment cabinet comprising a support with a plurality of through holes defined therein;

a slide rail;

a mounting bracket slidably engaging with the slide rail, and comprising a post extending into one of the plurality of the through holes of the support;

a locking mechanism attached to the mounting bracket, wherein the locking mechanism is resilient, and comprises a resisting portion to resist against the support to prevent the post disengaging from the through hole in response to the slide rail sliding relative to the mounting bracket thereby placing the mounting bracket at a lock position, wherein sliding the slide rail to a first position relative to the mounting bracket overcomes the elasticity of the locking mechanism; and sliding the slide rail to a second position relaxes the locking mechanism and disengages the locking mechanism from the support to place the mounting bracket at an unlocked position.

9. The assembly as described in claim 8, wherein the slide rail comprises a receiving portion, the locking mechanism comprises a wedge-shaped portion received in the receiving portion in response to the mounting bracket at the unlocked position, or misaligned with the receiving portion, thereby resisting against the slide rail in response to the mounting bracket at a locked position.

10. The assembly as described in claim 9, wherein the locking mechanism further comprises a locking member forming the resisting portion, and a supporting member placed between the locking member and the mounting bracket, the supporting member abuts against the locking member and forms the wedge-shaped portion thereon.

11. The assembly as described in claim 9, wherein the locking mechanism is a single-component member, which forms the resisting portion and the wedge-shaped portion.

12. The assembly as described in claim 9, further comprising a clipping element, wherein the slide rail further comprises a sliding slot defined therein; the clipping element comprises a fixing portion slidably received in the sliding slot and fixed to the mounting bracket, and a pair of wings configured for abutting against a side surface of the slide rail opposite to the mounting bracket.

13. The assembly as described in claim 10, wherein the supporting member further comprises a main body abutting against the locking member; the wedge-shaped portion is formed on the main body; the locking member is urged away from the mounting bracket when the wedge-shaped portion resists against the slide rail.

14. The assembly as described in claim 13, wherein the supporting member further comprises a pair of legs extending from the main body, each leg forms a retaining portion at a distal end thereof; the mounting bracket further comprises a pair of locating holes configured to fix the retaining portions therein.

* * * * *